US006164619A

United States Patent [19]

Van Winkle et al.

[11] Patent Number: 6,164,619

[45] Date of Patent: Dec. 26, 2000

[54] BI-DIRECTIONAL SEALING RAM

[75] Inventors: Denzal Wayne Van Winkle, Santa Maria, Calif.; David McWhorter, Magnolia, Tex.

[73] Assignee: Tuboscope I/P, Inc., Conroe, Tex.

[21] Appl. No.: 09/226,197

[22] Filed: Jan. 7, 1999

[51] Int. Cl.[7] ..... E21B 33/06

[52] U.S. Cl. ..... 251/1.3; 277/325; 166/85.4; 137/112

[58] Field of Search ..... 277/325; 251/1.3, 251/1.2, 1.1; 166/53, 85.4; 137/112

[56] References Cited

U.S. PATENT DOCUMENTS 4,655,431 4/1987 Helfer et al. ..... 251/1.3
4,943,031 7/1990 Van Winkle ..... 251/1.3
5,074,518 12/1991 Berry ..... 251/1.1
5,890,698 4/1999 Domytrak ..... 251/1.1

*Primary Examiner*—David Bagnell
*Assistant Examiner*—Jennifer R. Dougherty
*Attorney, Agent, or Firm*—Felsman, Bradley, Vaden, Gunter & Dillon, L.L.P.

[57] ABSTRACT

A shuttle valve assembly in a ram-type BOP selectively connects the volume behind the rams to the more highly pressurized wellbore volume adjacent to the rams (either above or below the rams). The connection made is free flowing in both directions (no check valves) allowing for evacuation and fluctuations with changes in wellbore pressure.

9 Claims, 4 Drawing Sheets

BI-DIRECTIONAL SEALING RAM

FIELD OF THE INVENTION

The present invention relates generally to the field of oil field apparatus, and, more particularly, to ram-type blowout preventers.

BACKGROUND OF THE INVENTION

Conventional ram type blowout preventers (BOPs) are designed to seal full working pressure from one direction only. In such BOPs, pressure below the rams assists the sealing mechanism by pushing the rams together. Wellbore pressure is allowed behind the rams and the wellbore pressure assist-force is equal to the unbalanced area of the ram times the wellbore pressure. The unbalanced area of the ram is that area of the ram's crossection that has wellbore pressure on one side and not the other. Generally, the midline of the ram is the approximate demarcation line of the balanced and unbalanced zones of the ram when sealing from below. Also, the force resulting from the wellbore pressure acting over the cross sectional area of the piston rod must be subtracted from the wellbore assist force.

When attempting to seal from above with a ram-type BOP, wellbore pressure is prevented from getting behind the rams by the rear (i.e., top) seal. The resulting unbalanced force ((wellbore pressure)×(ram unbalanced cross sectional area)) acts in the direction tending to force the rams apart and reduce the ram's ability to seal. Depending on the actuator size and ram design, some pressure can be held from above, but typically it is only a fraction of the rated working pressure of the BOP. Others have suggested a BOP which will hold a pressure from above the rams, but such a BOP apparently requires an oversized operator to hold the pressure. An exception to the general rule regarding the holding of pressure from above without a large operator applies to low pressure rated (less than 3000 psi) small bore (less than 3.06" diameter) BOPs where it is practical to apply ram closing force that may be adequate to overcome the wellbore force trying to open the rams and thereby seal full working pressure from above or below.

The wellbore assist principle is the basis for all ram-type drilling and coiled tubing BOPs as well as most wireline BOPs (those not falling within the exception in the preceding paragraph). Without wellbore assist, the BOP's actuators would have to be truly massive resulting in a number of design problems and impracticalities.

In those instances where sealing from above is a requirement (usually to hold pressure for a test of equipment higher in the stack), a ram or the entire BOP is often inverted. This inverted BOP is then no longer suitable as a barrier for downhole pressure. A true bi-directional sealing ram type BOP would eliminate the necessity for an additional inverted BOP, replacing it with a single BOP to contain either well pressure from below, or test pressure from above the BOP.

Bi-directional sealing rams have been proposed that would include a 360 degree rear seal (as opposed to the conventional 180 degree seal) and a set of check valves that would let pressure behind the rams regardless of the point of origin of the assist pressure (from above or below). The resulting wellbore assist force would adequately force the rams together and effect a seal at any standard working pressure. However, since the pressure is locked in by the check valves, an arrangement of this sort allows no provision for evacuating the volume behind the ram of pressure short of a manual dump valve, an arrangement that is unacceptable and possibly dangerous. Pressure would have to be manually dumped prior to opening the BOP and would have to be directed to the low pressure side of the ram (maybe above, maybe below depending on circumstances) requiring a valve manifold system to be in place. There are many undesirable features to this concept, not the least of which is the great potential for human error and injury. in addition, pressure behind the ram is trapped at the highest pressure encountered, thus applying undue high stress on the sealing elements when the pressure is reduced.

Thus, there remains a need for a bi-directional ram-type BOP in which pressure-assist is applied to the backs of the rams, and the pressure cannot be trapped behind the rams, regardless of whether it is the top or the bottom of the BOP which is at the higher pressure.

SUMMARY OF THE INVENTION

The present invention addresses these and other drawback of the prior art by providing an automatic shuttle valve that responds to the pressure sensed from above and below the BOP and automatically positions to port the higher pressure to the backs of the rams.

In another aspect of this invention, a mechanism is provided that selectively connects the volume behind the rams to the more highly pressurized wellbore volume adjacent to the rams (either above or below the rams). The connection made is free flowing in both directions (no check valves) allowing for evacuation and fluctuations with changes in wellbore pressure.

The apparatus of this invention may be incorporated into the body of the BOP itself, as a bolt on item that plugs into the side of the BOP body or may be made integral with the ram.

These and other aspects of this invention will be apparent to those skilled in the BOP art from a review of the following detailed description and the accompanying drawing figures.

DETAILED DESCRIPTION OF A PREFERRED EMBODIMENT

Figure 1:
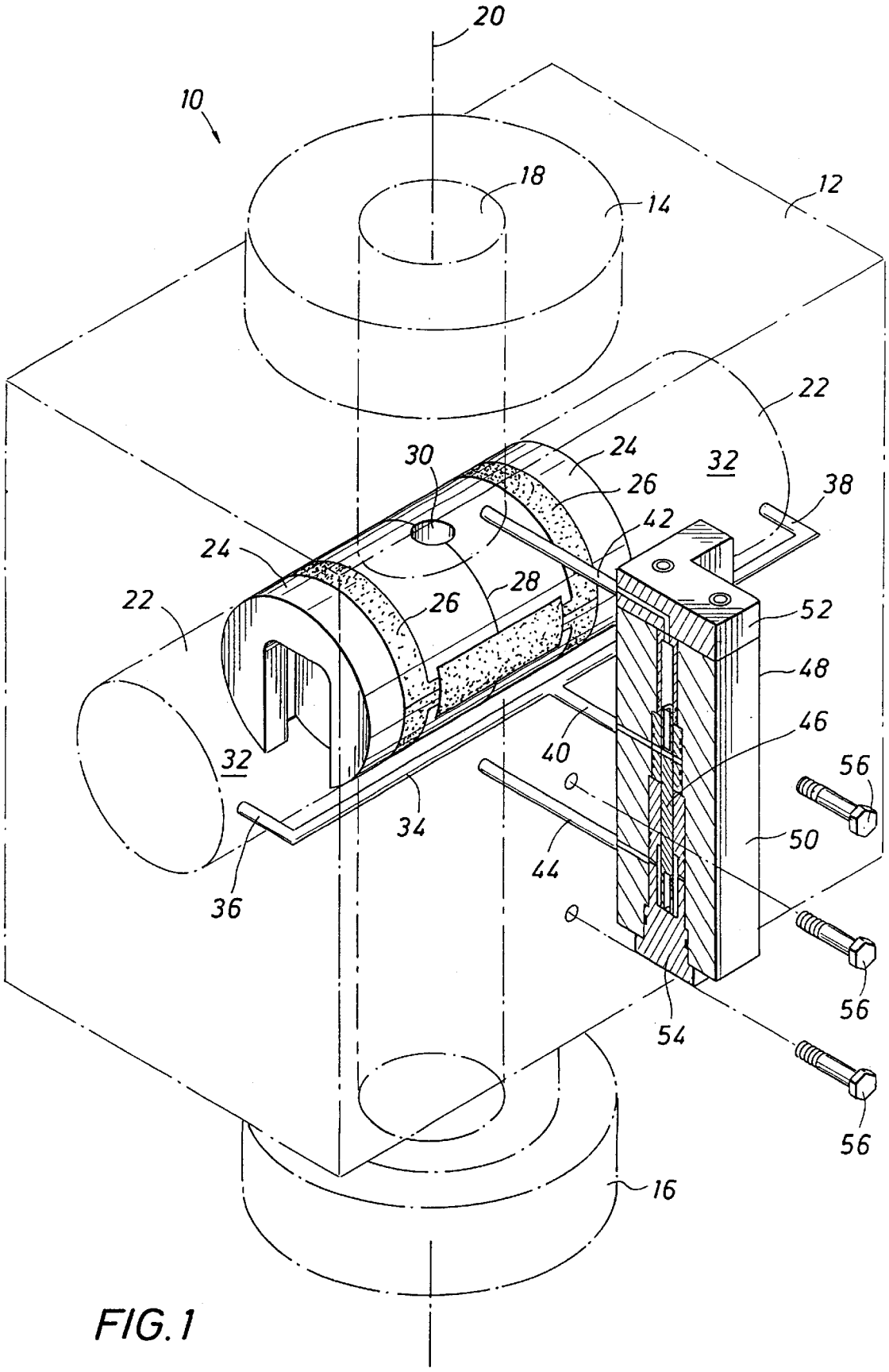
FIG. 1 is a perspective view of a BOP body (shown in phantom) with a set of BOP rams within and the shuttle valve assembly of this invention shown in section as a bolt-on item.

FIG. 1 shows the present invention as a "bolt-on" item for clarity. It will be understood by those skilled in the art that the invention may as easily be made a part of the ram assembly, or within the body of the BOP itself.

Referring now to FIG. 1, a blowout preventer (BOP) 10 comprises a BOP body 12 which may be coupled to other wellbore surface components as by an upper flange 14 and a lower flange 16. The BOP body 12 defines an axial bore 18 along an axis 20, which in the conventional manner receives a tubular member, such as pipe, coiled tubing, a wire-line, and the like.

Extending radially outward from the bore 18 are opposing chambers 22, which hold opposing ram assemblies 24 which seal against the opposing chamber 22 with seals 26. Note that the seals 26 go all the way around the rams to seal the assist pressure behind the rams. When the rams are closed, as in FIG. 1, the opposing ram assemblies 24 meet at an abutting face 28 and seal around a tubular member at a ram bore 30.

Behind each ram assembly 24 is a volume 32 to which ram-assist pressure may be applied to help seal the ram. Each volume 32 behind its respective ram assembly is coupled to a hydraulic manifold 34 through an inlet line 36 for the left ram assembly (as seen in FIG. 1) or 38 for the right ram assembly. The manifold 34 is pressurized by pressure from a pressurization conduit 40.

Pressure is sensed above the rams by a top sense line 42 and below the rams by a bottom sense line 44. The higher of the pressures on the lines 42 and 44 determines the position of a shuttle 46 within a shuttle valve assembly 48. The shuttle valve assembly is shown in greater detail in FIGS. 2 and 3. If the pressure above the rams is greater than the pressure below the rams, the shuttle will be positioned in its downwardmost travel, and shown in FIG. 1. The pressure from above the rams will therefore be communicated through the shuttle valve assembly into the pressurization conduit 40, into the manifold 34, and into the inlet lines 36 and 38. Thus, pressure is ported into the volumes 22 behind the ram assemblies 24, assisting in holding the rams shut. Similarly, if higher pressure is sensed from below the rams, the shuttle 46 will automatically position at the upwardmost extent of travel, and this higher pressure will once again be ported to the pressurization conduit 40.

The shuttle valve assembly 48, in addition to the shuttle 46, comprises a shuttle valve body 50, a cover 52, and a bottom plug 54. These components described the currently preferred embodiment, and other arrangements may be developed fully within the scope of this invention. As shown in FIG. 1, the cover 52 may also provide a conduit for fluid between the shuttle valve and the sense line 42. Further as shown, the present invention may be bolted on to an existing ram-type BOP, as with bolts 56 or other appropriate means.

Figure 2:
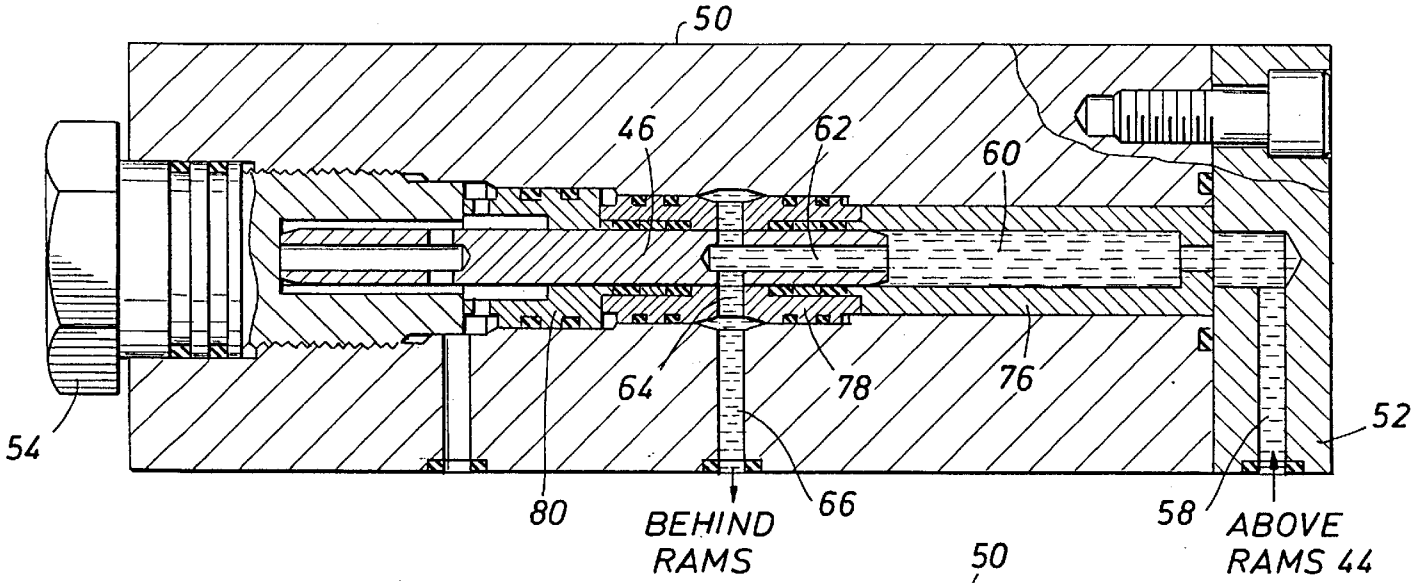
FIG. 2 is a section view of the shuttle valve assembly showing the orientation of the valve shuttle when the higher pressure is sensed from above the BOP rams.
Figure 3:
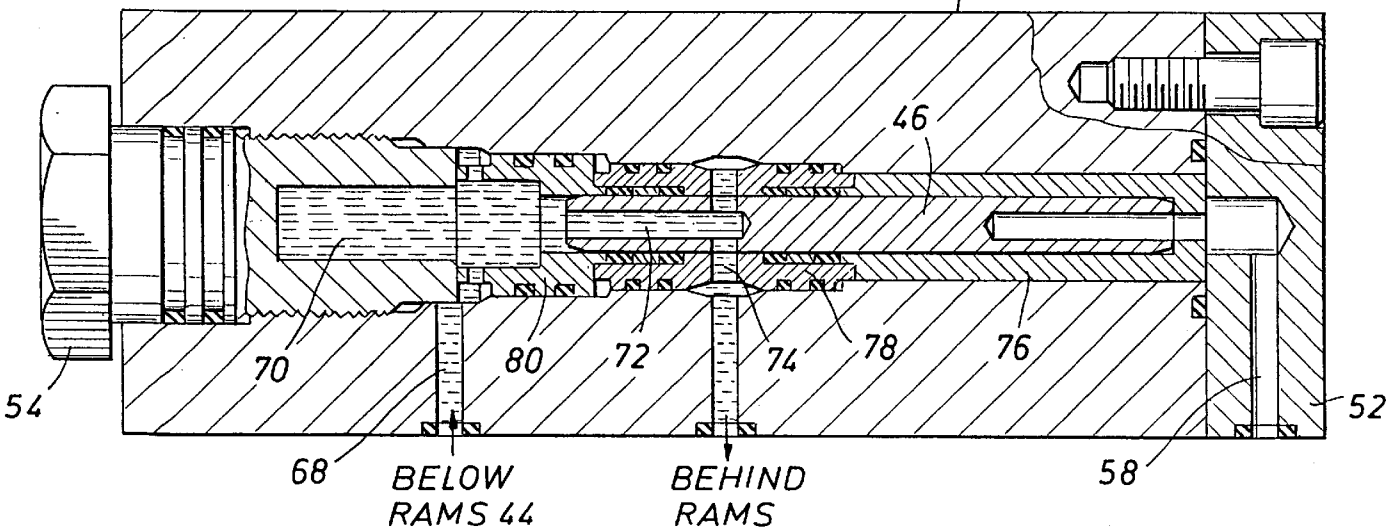
FIG. 3 is a section view of the shuttle valve assembly showing the orientation of the valve shuttle when the higher pressure is sensed from below the BOP rams.

FIGS. 2 and 3 provide a side section view of the currently preferred embodiment of the shuttle valve assembly. These figures also depict the assembly in the orientations when the pressure is higher above the rams (FIG. 2) and below the rams (FIG. 3).

Referring now to FIG. 2, the shuttle valve assembly comprises a body 50, a cover 52, and a plug 54. The cover 52 may provide a conduit 58 to conduct fluid (shown as shading in FIGS. 2 and 3) into a first actuation volume 60 of the shuttle valve assembly. The first actuation volume 60 communicates with a first axial channel 62 into a first radial channel 64. With the shuttle 46 aligned as shown in FIG. 2, the first radial channel 64 aligns with a channel 66, which couples to the pressurization conduit 40 (FIG. 1).

Similarly, with higher pressure sensed from below the rams, the shuttle 46 will automatically position as shown in FIG. 3. The sense line 44 (FIG. 1) couples to an inlet line 68 into a second actuation volume 70. Higher pressure in the second actuation volume 70 moves the shuttle 46 to the right as shown in FIG. 3. The actuation volume 70 communicates with a second axial channel 72 into a second radial channel 74. With the shuttle 46 aligned as shown in FIG. 3, the second radial channel 74 aligns with the channel 66 and communicates the pressure to the line 40 (FIG. 1 ).

For manufacturing purposes, the shuttle valve assembly 48 may also include a sleeve 76, which also serves as a guide for the shuttle 46; an insert 78, which provides the alignment between the axial channels 62 and 72, depending on shuttle position; and a sleeve 80, which also serves as a shuttle guide.

Figure 4:
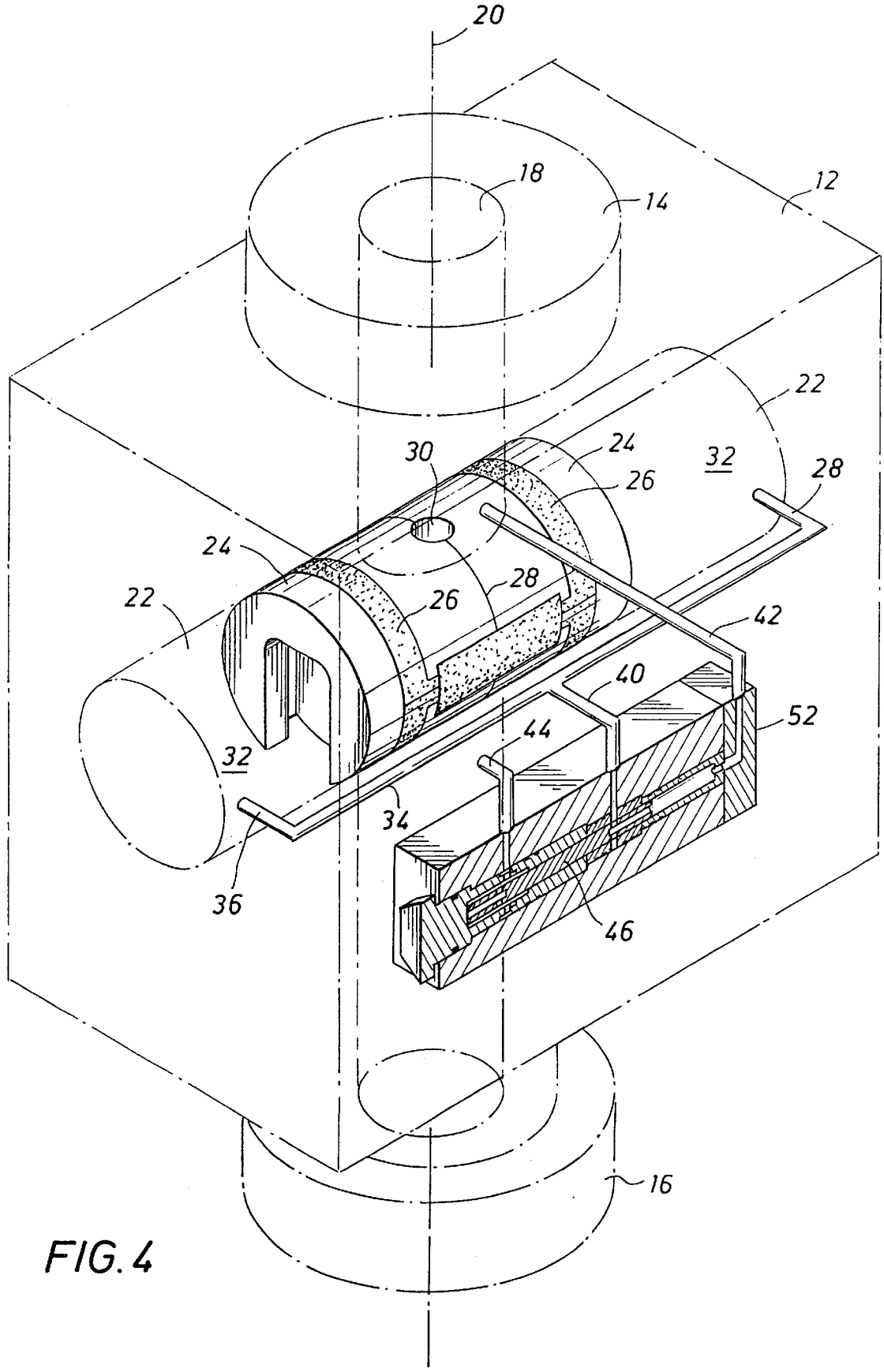
FIG. 4 is a perspective view of a BOP body (shown in phantom) with a set of BOP rams within and the shuttle valve assembly of this invention shown in section as an integral component of the BOP body.

FIG. 4 depicts this invention in a preferred embodiment in which the shuttle valve assembly is incorporated as a component within the body 12 of the BOP. This embodiment has the advantage of saving the space that would otherwise be occupied by the shuttle valve assembly outside the body 12 of the BOP, but it also has the disadvantage of increasing the complexity of the BOP itself. Either, however is, within the scope of this invention.

The primary components of the invention, whether in FIG. 1 or FIG. 4, are the same, and the components have been numbered the same. The primary components just alluded to are the shuttle 46, the sleeves 76 and 80, the insert 78, and the plug 54. While FIG. 4 also shows the shuttle valve body and the cover, these components are not required in the preferred embodiment, since shuttle bore may be machined or otherwise formed in the BOP body. Also, in the embodiment of FIG. 4, the sensing lines 42 and 44, and the pressurization conduit 40, are all internal to the BOP body 12. It is preferred that the shuttle valve assembly be constructed as a cartridge and inserted into a cavity in the body of the BOP for ease of manufacture.

Figure 5:
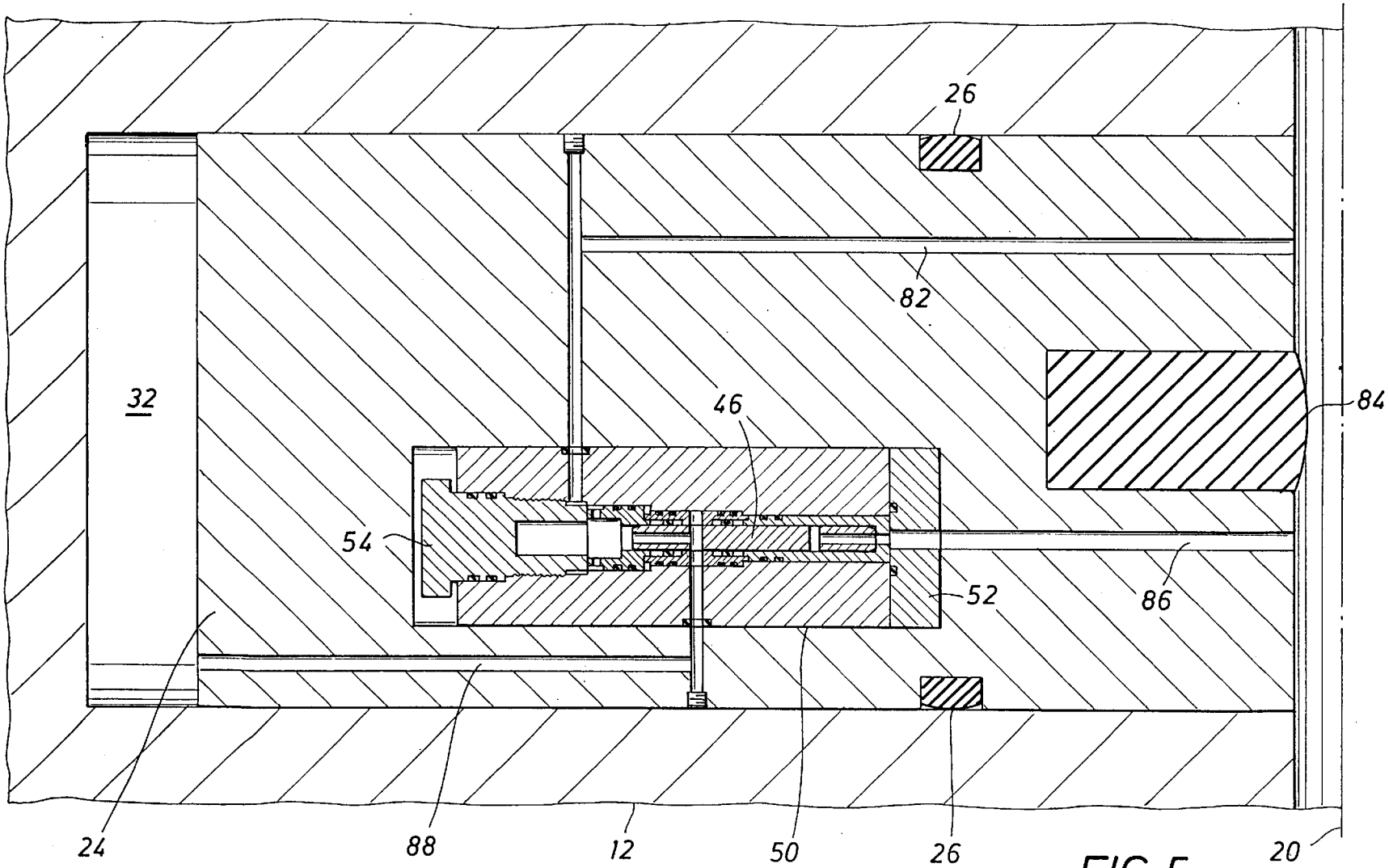
FIG. 5 is a section view of a ram assembly with a shuttle valve assembly integral to the ram assembly.

FIG. 5 depicts another embodiment of this invention, in which the shuttle valve assembly 48 is included as an integral part of a ram assembly 24. This embodiment eliminates the need for the modification of the BOP body 12, and still saves the space that otherwise would be taken up by the bolt-on embodiment of FIG. 1. However, this embodiment requires modification of the ram assemblies, and is more space-limited than embodiments previously described.

It should also be understood that, as with the embodiment of FIG. 4, the shuttle valve body 50 and the cover 52 are preferably eliminated, since these components would be machined or otherwise formed in the ram body.

In this embodiment, a sense line 82 senses pressure above a ram seal 84, and a sense line 86 senses pressure below the seal 84. The higher of the pressures automatically determines the position of the shuttle 46 within the shuttle valve assembly, to port that pressure to the volume 32 via a pressure assist line 88. The shuttle valve assembly components are the same in this embodiment as embodiments previously described, as with FIG. 4, so the body and cover are integral to the ram body. The shuttle valve assembly is shown horizontally oriented in FIG. 5, which may require that the ram assembly be made longer than without the shuttle valve assembly, and the valve assembly may also be oriented vertically as seen in FIG. 5.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

We claim:

1. A ram-type blowout preventer comprising:

a BOP body having an axial bore and opposing chambers extending radially outward from the bore;

opposing ram assemblies in the opposing chambers, each of the ram assemblies defining a forward end toward to axial bore, and an after end;

a hydraulic manifold for coupling hydraulic pressure to the after end of the each ram assembly, the manifold having a pressure inlet port, and a shuttle valve assembly comprising:

a. a valve body defining a longitudinal bore, a with a first end of the longitudinal bore in fluid communication with the BOP axial bore above the opposing chambers and a second end of the longitudinal bore in fluid communication with the BOP axial bore below the opposing chambers;

b. a shuttle within the bore of the valve body, the shuttle having a first channel for porting pressure from the first end of the longitudinal bore to the pressure inlet port when the shuttle is in a first position and a second channel for porting pressure from the second end of the longitudinal bore to the pressure inlet port when the shuttle is in a second position, to automatically port the higher of the pressure above and below the ram assemblies to the after ends of the ram assemblies; and c. an insert within the bore to alternately align the first and second channels with the inlet port.

2. The blowout preventer of claim 1, wherein the shuttle valve assembly is external of the BOP body.

3. The blowout preventer of claim 1, wherein the shuttle valve assembly is integral with and inside the BOP body.

4. The blowout preventer of claim 1, wherein the shuttle valve assembly is integral with and internal to a ram assembly.

5. The blowout preventer of claim 1, wherein the valve body comprises an elongate body with the longitudinal bore therein, a cover closing off the longitudinal bore at one end thereof, and a plug closing off the other end of the longitudinal bore.

6. The blowout preventer of claim 1, further comprising a guide sleeve within the bore to guide the shuttle.

7. The blowout preventer of claim 5, wherein the cover defines a conduit for conducting fluid pressure from the axial bore of the BOP body to the longitudinal bore of the shuttle valve assembly.

8. In a ram-type blowout preventer, a method of automatically providing assist pressure to the rams from the higher of the pressures from above or below the rams, comprising the steps of:

a. sensing the pressure above and below the rams;

b. automatically positioning a shuttle valve, which positioning is accomplished by the higher of the pressure above and below the rams, to direct the higher of the pressures to volumes in the blowout preventer behind the rams and, c. when pressure below the rams then falls below pressure behind the rams, permitting pressure from behind the rams to bleed to below the rams.

9. The method of claim 8, further comprising the step of repositioning the shuttle valve if the relative pressure above and below the rams reverses.

* * * * *